US006843334B2

(12) United States Patent
Schautt

(10) Patent No.: US 6,843,334 B2
(45) Date of Patent: Jan. 18, 2005

(54) DRILLING HEAD OF A ROCK DRILL

(75) Inventor: Martin Schautt, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/050,223

(22) Filed: Jan. 16, 2002

(65) Prior Publication Data

US 2002/0108789 A1 Aug. 15, 2002

(30) Foreign Application Priority Data

Jan. 17, 2001 (DE) ..... 107 17 262

(51) Int. Cl.[7] ..... E21B 10/40; E21B 10/16
(52) U.S. Cl. ..... 175/430; 175/401; 175/420.1
(58) Field of Search ..... 175/426, 428, 175/430, 414, 420.1, 401, 385, 387, 388, 392, 403, 404

(56) References Cited

U.S. PATENT DOCUMENTS

| | | | | | |
|---|---|---|---|---|---|
| 3,647,310 | A | * | 3/1972 | Morse | 408/239 R |
| 3,690,390 | A | * | 9/1972 | Chromy | 175/388 |
| 3,773,122 | A | * | 11/1973 | Chromy | 175/385 |
| 3,960,223 | A | * | 6/1976 | Kleine | 175/385 |
| 4,275,796 | A | * | 6/1981 | Kleine | 175/385 |
| 4,729,441 | A | * | 3/1988 | Peetz et al. | 175/385 |
| 5,273,380 | A | | 12/1993 | Musacchia | 408/230 |
| 5,466,099 | A | * | 11/1995 | Sullivan et al. | 408/206 |
| 5,492,187 | A | * | 2/1996 | Neukirchen et al. | 175/394 |
| 5,775,445 | A | * | 7/1998 | Kleine | 175/385 |
| 5,779,403 | A | * | 7/1998 | Kleine et al. | 408/230 |
| 6,032,749 | A | * | 3/2000 | Bongers-Ambrosius et al. | 175/394 |
| 6,073,710 | A | * | 6/2000 | Popp et al. | 175/388 |
| 6,116,827 | A | * | 9/2000 | Moser et al. | 408/204 |
| 6,129,162 | A | * | 10/2000 | Hauptmann | 175/394 |
| 6,213,230 | B1 | * | 4/2001 | Fuss | 175/389 |
| 6,283,232 | B1 | | 9/2001 | Batliner | |
| 6,450,272 | B2 | * | 9/2002 | Hauptmann et al. | 175/394 |
| 2001/0013430 | A1 | * | 8/2001 | Hauptmann et al. | 175/415 |

FOREIGN PATENT DOCUMENTS

| | | |
|---|---|---|
| DE | 4012771 | 10/1991 |
| EP | 0965405 | 12/1999 |

* cited by examiner

*Primary Examiner*—David Bagnell
*Assistant Examiner*—Jennifer H Gay
(74) *Attorney, Agent, or Firm*—Sidley Austin Brown & Wood, LLP

(57) ABSTRACT

A drilling head of a rock drill for use with a hand-held power tool is formed completely of a hard material and includes a main bit (2) and at least one auxiliary bit (3*a*, 3*b*). The at least one auxiliary bit (3*a*, 3*b*) is provided exclusively in a radially outer region of the drilling head and has an arcuate cutting edge (4*a*, 4*b*).

5 Claims, 1 Drawing Sheet

DRILLING HEAD OF A ROCK DRILL

BACKGROUND OF THE INVENTION

1. Field of the Invention

The present invention relates to a drilling head of a rock drill for use in a rotary-percussion power tool for removing stone and stone-like material such as, e.g., concrete.

2. Description of the Prior Art

Rock drills, which are used in hand-held power tool, have, at one end of their stems, a shank and, at the other, opposite end, a drilling head with cutting elements formed of a hard material. The cutting elements are usually formed as cutting plates or bits. Alternatively, the entire drilling head with the cutting elements can be formed of a hard material. A drawback of this type of drilling heads consists in that upon striking a reinforcing metal during the drilling of concrete, the cutting edges are subjected to an increased load. This is particularly the case when the drilling heads are formed with a pointed wedge angle that is particularly suitable for an increased drilling capacity of the tool.

British Publication GB 530113A discloses a drilling head of a rock drill having a main cutting plate and two auxiliary cutting plates radially offset relative to the main cutting plate and having their cutting edges extending parallel to each other.

European Publication EP 607958A1 discloses a rock drill in which two auxiliary cutting plates, which have their cutting edges extending parallel to each other, are radially spaced from the main cutting plate by different distances.

U.S. Pat. No. 5,492,187 discloses a rock drill with a compact drilling head formed entirely of a hard material. The drilling head has a diametrically extending main bit and two auxiliary bits which are provided exclusively in radially outer region. The auxiliary bits trail the main bit and extend at an acute angel in the drilling direction. The cutting edges of the auxiliary bits extend radially. Because of a rapid wear of the main bit, which is arranged axially in front of the auxiliary bits, the axial distance between the main bit and the auxiliary bits becomes reduced which, in turn, reduces the drilling capacity of the drill and its service life.

Accordingly, an object of the present invention is to increase the service life of a drilling head.

Another object of the present invention is to reduce the danger of the drilling head being fractured upon striking reinforcing metal.

SUMMARY OF THE INVENTION

These and other objects of the present invention, which will become apparent hereinafter, are achieved by providing a drilling head formed of a hard material and having a main bit and at least one auxiliary bit provided exclusively in a radially outer region of the drilling head and having an arcuate cutting edge.

The arcuate shape of the cutting edge of the auxiliary bit increases the cutting edge length in the tangential direction in which it is primarily loaded upon striking reinforcing metal. This increases the load resistance and the service life of the drilling head.

Advantageously, the arcuate cutting edge of the auxiliary bit is circumferentially axially rounded. This insures that upon the auxiliary bit cutting edge and opposite cutting surfaces striking the reinforcing metal, the drill is axially lifted.

Advantageously, the drilling head has two auxiliary bits which are, advantageously, are arranged symmetrically with respect to the main bit. This permits to reduce the vibration noise.

Advantageously, the main bit has two cutting edges which are diametrically offset relative to each other and are connected at the drilling head tip by a top edge. This insures obtaining of stable drilling characteristics.

Advantageously, the auxiliary bit is arranged axially behind the generating curve of the main bit, which provides for a possibility to increase the force acting on the main bit which in turn, increase the drilling capacity of the drill.

Advantageously, the auxiliary bits form in a radial plane a pointed wedge angle between 50° and 80°. This insures a more aggressive penetration of the auxiliary bit(s) into hard material, thereby increasing the drill drilling capacity.

Advantageously, the length of the cutting edge of the auxiliary bit is so selected that both the main bit and the auxiliary bit(s) are subjected to the same amount of the axial wear. This also increases both the service life of a drill and its drilling capacity.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment when read with reference to the accompanying drawing.

DETAILED DESCRIPTION OF THE PREFERRED EMBODIMENTS

Figure 1:
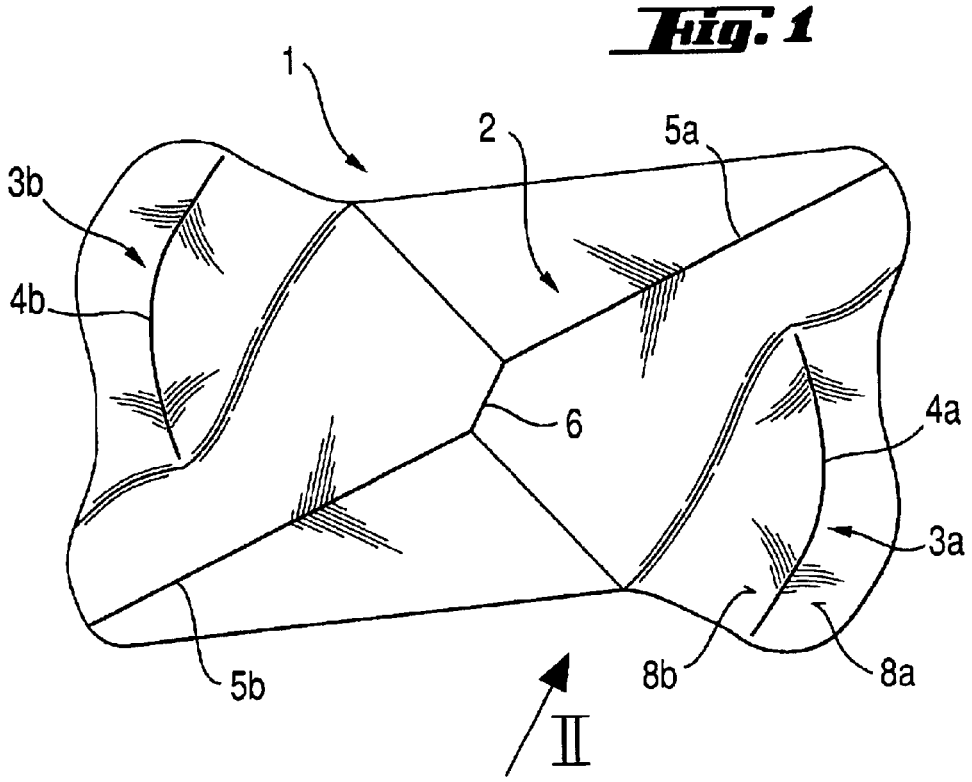
FIG. 1 shows a top view of a drilling head according to the present invention.
Figure 2:
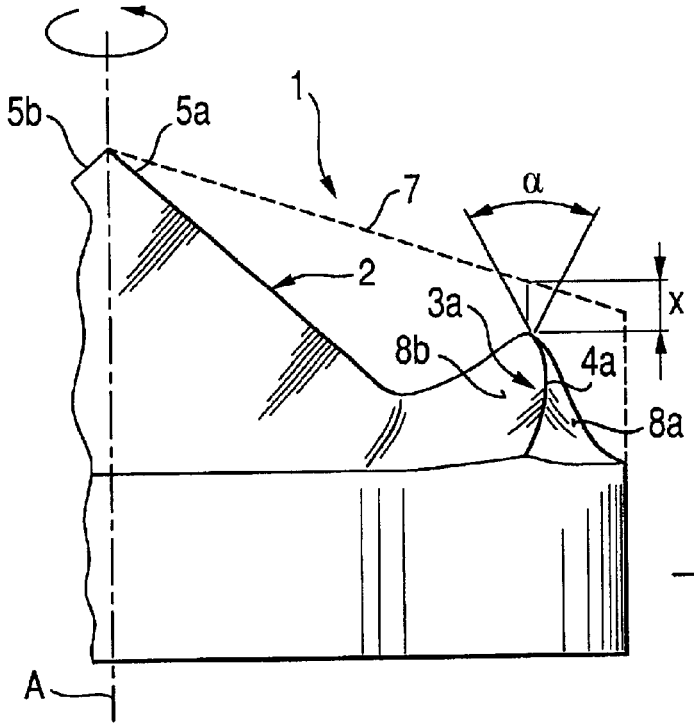
FIG. 2 shows a side view of a portion of the drilling head shown in FIG. 1.

FIGS. 1–2 show drilling head 1 according to the present invention which is completely formed of a hard material and forms part of a rock drill for use with a hand-held power tool. The drilling head 1 has a main bit 2 and two diametrically opposite auxiliary bits 2*a*, 3*b* arranged symmetrically relative to the main bit 2 in radially outer region of the drilling head 1. The auxiliary bits 3*a*, 3*b* have, respectively arcuate, extensively axially rounded, edges 4*a*, 4*b*. The main bit 2 has two cutting edges 5*a* 5*b* which are connected at the drill tip by a top edge 6. Both auxiliary bits 3*a*, 3*b* have an arcuate length of about $\pi/4$ radian.

The portion of the drilling head 1, which is shown in side view in FIG. 2, has an axially offset, with respect to the drilling head axis A, auxiliary bit 3*a* which is spaced by a distance X from a generating curve 7 of the main bit 2. This auxiliary bit 3*a* forms, in a radial plane extending transverse to the auxiliary bit cutting edge 4*a*, a pointed wedge angle $\alpha$ of about 65°. The wedge angle $\alpha$ defines two, partially concave, cutting surfaces 8*a*, 8*b*.

Though the present invention was shown and described with references to the preferred embodiment, such is merely illustrative of the present invention and is not to be construed as a limitation thereof, and various modifications to the present invention will be apparent to those skilled in the art.

It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A one-piece drilling head of a rock drill for use with a hand-held power tool and formed completely of a hard material, the drilling head comprising a main bit (2) and at least one auxiliary bit (3*a*, 3*b*) arranged on a same surface as the main bit, provided exclusively in a radially outer region of the drilling head completely radially outwardly of the main bit (2) and having an arcuate cutting edge (4*a*, 4*b*), wherein the arcuate cutting edge (4*a*, 4*b*) of the at least one auxiliary bit is circumferentially axially rounded.

2. A drilling head according to claim 1, wherein the main bit (2) has two, diametrically offset, cutting edges (5*a*, 5*b*).

3. A drilling head according to claim 2, wherein the two cutting edges of the main bit (2) are connected, at a drilling head tip, by an edge (6).

4. A drilling head according to claim 1, wherein the at least one auxiliary bit (3*a*, 3*b*) is axially offset with respect to a generating curve (7) of the main bit (2).

5. A one-piece drilling head of a rock drill for use with a hand-held power tool and formed completely of a hard material, the drilling head comprising a main bit (2) and at least one auxiliary bit (3*a*, 3*b*) arranged on a same surface as the main bit provided exclusively in a radially outer region of the drilling head completely radially outwardly of the main bit (2), and having an arcuate cutting edge (4*a*, 4*b*), wherein the at least one auxiliary bit (3*a*, 3*b*) forms, in a radial plane, a pointed wedge angle ($\alpha$) between 50° and 80°.

* * * * *